US006273740B1

(12) United States Patent
Lord

(10) Patent No.: US 6,273,740 B1
(45) Date of Patent: Aug. 14, 2001

(54) QUICK RELEASE SPRING CONNECTOR ADAPTOR FOR A COMPUTER CABLE

(75) Inventor: Charles Lord, Scottsdale, AZ (US)

(73) Assignee: Mobility Electronics Inc., Scottsdale, AZ (US)

( * ) Notice: Subject to any disclaimer, the term of this patent is extended or adjusted under 35 U.S.C. 154(b) by 0 days.

(21) Appl. No.: 09/621,106

(22) Filed: Jul. 21, 2000

(51) Int. Cl.[7] ..... H01R 13/627
(52) U.S. Cl. ..... 439/353; 439/953
(58) Field of Search ..... 439/352, 353, 439/357, 358, 362, 365, 953

(56) References Cited

U.S. PATENT DOCUMENTS 4,995,824 2/1991 Falco .
5,340,333 * 8/1994 Schroth ..... 439/607
5,486,117 1/1996 Chang .
5,713,752 2/1998 Leong et al. .
5,749,746 5/1998 Tan et al. .
5,775,931 7/1998 Jones .
5,797,771 * 8/1998 Garside ..... 439/610
6,165,002 12/2000 Kalis .

* cited by examiner

*Primary Examiner*—Brian Sircus
*Assistant Examiner*—Son V. Nguyen
(74) *Attorney, Agent, or Firm*—Jackson Walker LLP

(57) ABSTRACT

An adaptor for quickly connecting a computer cable connection to a receiving member including a body, a first and second port connector, and a biasing member. The biasing member maintains ratchet like teeth particularly useful in grasping internal threading such as that found in computer port housing. The connection apparatus securingly connects a traditional jack screw-type receiving member cable connection to a receiving member via actuation of the biasing member. The biasing member may preferably be a resilient member such as a spring or spring-like mechanism.

19 Claims, 4 Drawing Sheets

QUICK RELEASE SPRING CONNECTOR ADAPTOR FOR A COMPUTER CABLE

BACKGROUND OF THE INVENTION

1. Technical Field of the Invention

The present invention relates generally to port connection devices including serial, parallel and video port connectors, and, more particularly, to a computer port connector that can be selectively coupled to a mating connector.

2. Description of Related Art

In the market of portable electronic devices such as laptop computers and personal digital assistants (PDA's), a need has been established to expedite the connection and disconnection of the main computer to the peripheral devices (printers, monitors digital projectors, modem, for example).

Traditional means has been to couple the two mating sections and then thread opposing screws located on the mating section of the connector into jack screw receptacles of the fixed mating section. Some connectors have captive screws, requiring the user to physically use a screwdriver to secure the connectors, while others have an integral knob or handle to aid in the task. This means of securing the connection is time consuming and cumbersome.

What is needed is a connector adapted for quick connection and disconnection while retaining and using the traditional jack screw receptacles common to all devices while still providing a secure means of attachment.

SUMMARY OF THE INVENTION

The present invention achieves technical advantages as a system and method for connecting the port connection device in a predetermined orientation in which the need for additional components and site lines is alleviated. The present invention provides a method and user-friendly adaptor apparatus having a non screw-type port connector adapted to connect to a receiving member, wherein the receiving member is capable of accepting a traditional jack screw connector having screw-type fasteners. The adaptor further provides a receiving unit capable of accepting a common or traditional jack screw connection apparatus. The adaptor facilitates a more universal use of connection with traditional jack screw-type housing connectors that are commonly in use.

The present invention provides a method and a connector apparatus which securingly attaches to a common port member and the respective receiving member, while remedying the need for additional tools or attachment means, such as screws. The invention provides a connector more universal to all users, handicapped or otherwise. People having robotic limbs generally have a decreased ability to pick up and manipulate small objects. The present invention alleviates the use of screws or tools such that a person having decreased manipulative abilities may also use the device thereby making the application more universal.

The present invention also provides a method and an apparatus for secure attachment of the port connection to a receiving member which alleviates the need for a site line, thereby alleviating the need for manipulation of the receptive housing. Depending on the size and shape of a computer housing, manipulation of the machine may be difficult. However, if such manipulation is obviated, increased ease in connection of ports is facilitated.

The present invention also provides a method and an apparatus for securing a port mechanism wherein the risk of lost connection parts is allayed. The fewer the number of small parts, the less likely one should be missing any at the time of connection.

BRIEF DESCRIPTION OF THE DRAWINGS

For a more complete understanding of the present invention, reference is made to the following detailed description of the preferred embodiment taken in conjunction with the accompanying drawings, wherein like numerals refer to like elements, wherein.

DETAILED DESCRIPTION OF PREFERRED EMBODIMENT

Figure 1:
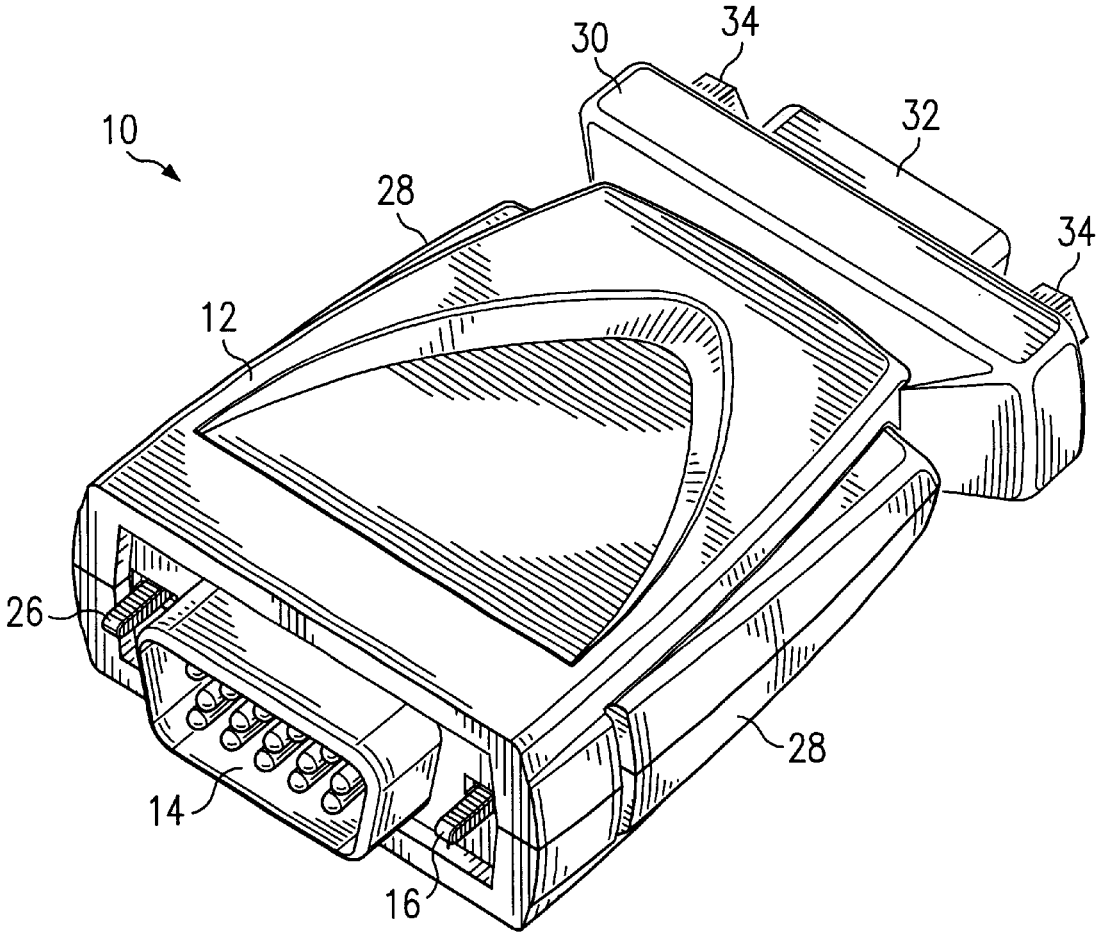
FIG. 1 is a perspective view illustrating a preferred embodiment of the external housing.
Figure 2:
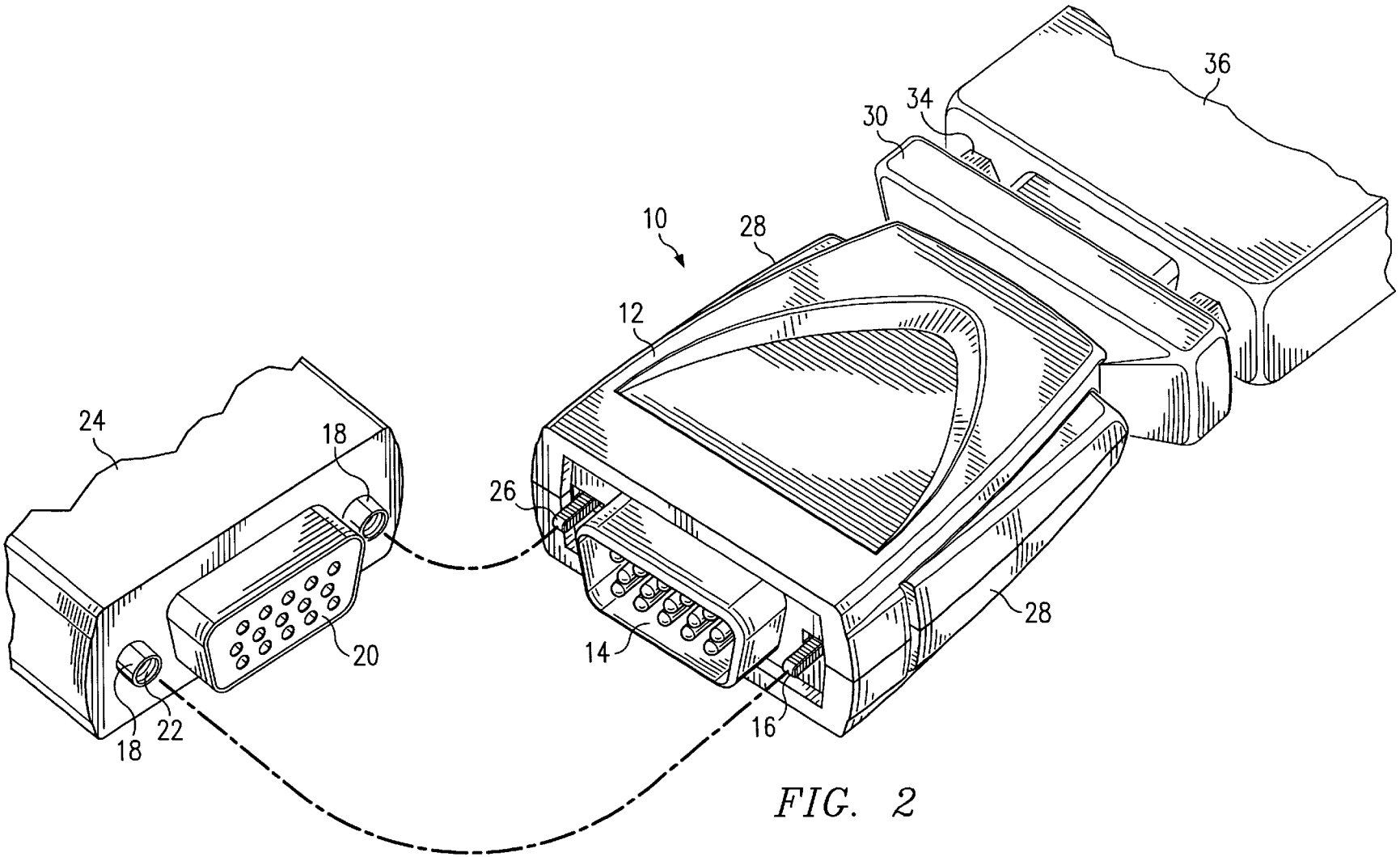
FIG. 2 is an exploded view of the adaptor capable of coupling to a conventional computer port and the respective receiving member.

The present invention comprises an adaptor capable of easily and quickly connecting and disconnecting to/from a receiving member. The adaptor includes a housing maintaining a port connection and a clasp mechanism at one end for releasingly and selectively securing the port connection to the receiving member, and an adaptive receiving end for releasingly and selectively securing the adaptor to a traditional jack screw connector having screw-type fasteners or the like. In reference to FIG. 1 and FIG. 2, FIG. 1 is a perspective view illustrating the adaptor 10. The port adaptor 10 includes a housing 12 maintaining a port connection 14 at one end, and a biasing member 16 adapted to clasp to a mechanism 18 provided on a common port receiving member as shown in FIG. 2. The conventional port receiving member 20 maintains internal threading 22 in mechanism 18 to receive screws and anchor the port connection 14 to a receiving connector 24. The biasing member 16 has distal end prongs 26 each adapted to anchor the port connector 14 of the adaptor 10 to the port receiving member 20 via threading 22. In the preferred embodiment of the computer port adaptor 10, biasing member 16 is actuated via the manual compression of opposing side housing buttons 28 which respectively engage portions of biasing member 16.

Adaptor 10 further includes an opposing adaptive end or region 30 maintaining a respective port receiving unit 32, and threaded regions 34 for releasingly and selectively securing the adaptor 10 to a traditional jack screw connector 36 having screw-type fasteners.

Adaptor 10 may be utilized for a variety of different uses depending upon the type of cable or wires maintained by the housing 12. The port connections 14 and 32 may be any type of port connection such as a parallel port, a serial port, video port, or any other means for port connection such as fiberoptic or infrared, for example.

FIG. 2 is an exploded perspective view of the adaptor 10 adapted to connect to port connector 20 using the clasp embodied as biasing member 16. Port connection 32 is adapted to receive the traditional jack screw connector 36, with the threaded regions 34 adapted to releasingly and selectively receive the screw-type fasteners of the traditional jack screw connector 36.

Figure 3A:
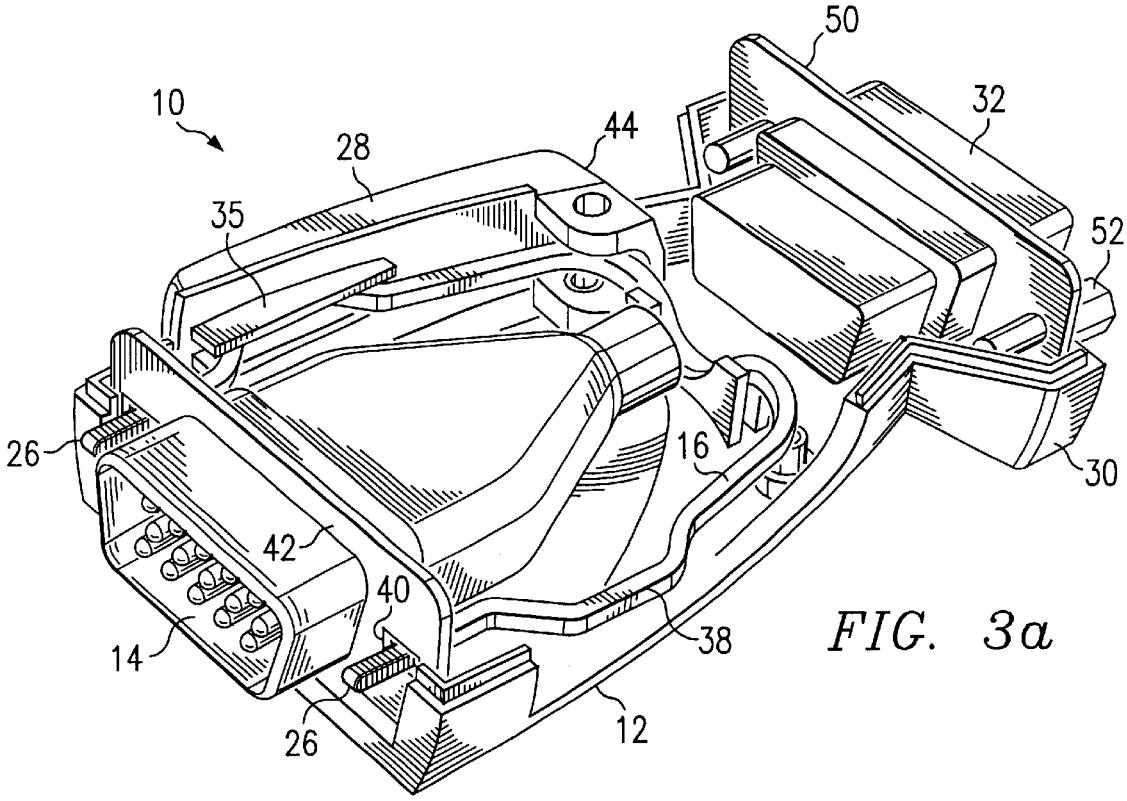
FIGS. 3*a–b* are a sectional perspective view of the preferred embodiment of FIG. 1 illustrating an easy lock computer port connector adaptor.
Figure 3B:
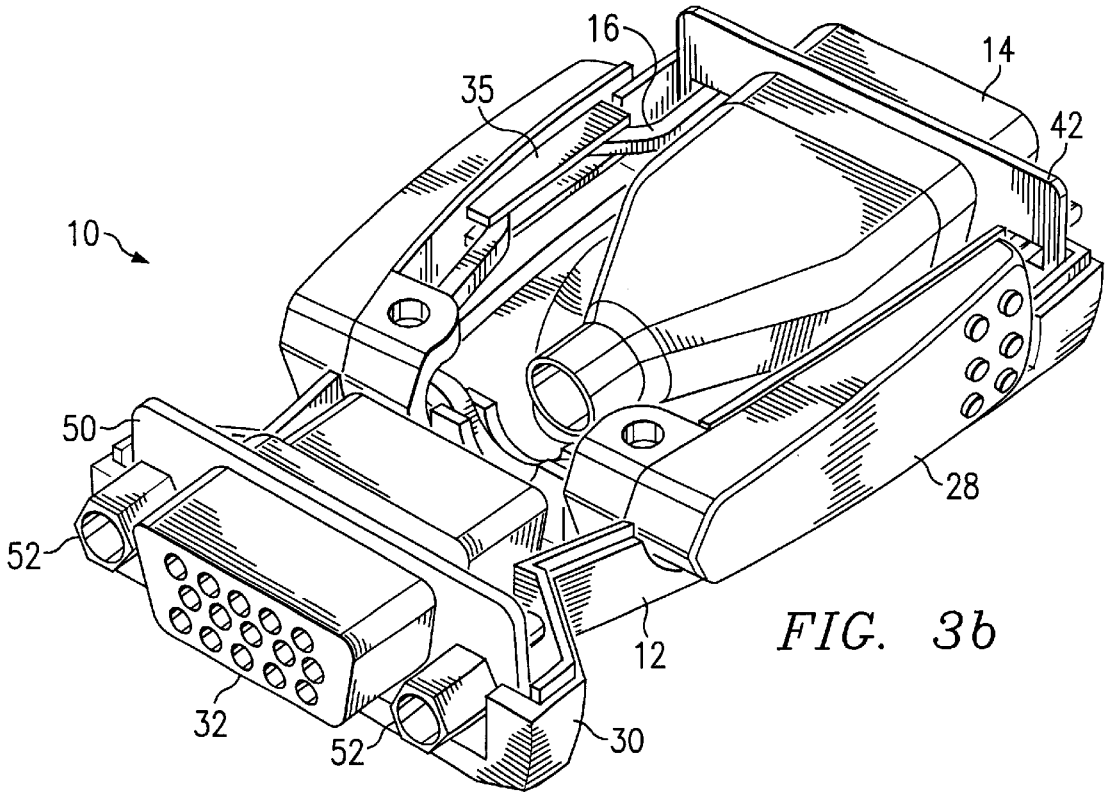

FIGS. 3*a–b* are partial cutaway perspectives of the preferred embodiment comprising the easy to lock computer port adaptor 10. The adaptor 10 comprises the housing 12, buttons 28, the port connection 14 maintained by the housing 12, and the biasing member 16, all previously shown in FIG. 1. FIG. 3*a* details the interior of the housing 12 and a front plate 42 receiving and holding the biasing member 16 and the port connection 14 in place. When buttons 28 are actuated inwardly, biasing member 16 is responsively compressed such that prongs 26 of the biasing member 16 are inwardly displaced within corresponding slots 40 of the plate 42. Each button 28 controls the compression of the receptive prong 26. Such actuation of the prongs 26 facilitates the release of the connector device 10 from port connector 20 by the release of the prongs 26 from the internal threading 22 of the receiving member 18.

In the preferred embodiment, distal end prongs 26 comprise tined or serrated outer surfaces defining grips as depicted in this figure. Such grips may be of a variety of shapes and sizes yet preferably are capable of, yet not limited to securingly connecting the port connection 14 to the receptive connector 24 by being received within and securing to screw-type port connectors mechanisms 18. Other means for securing, the port connection 14 to a receptive connector 24 include but are not limited to ratchet systems, teeth, threading on the outer side of the distal end prongs 26 or other obvious variations, for example. Such prongs 26 may preferably be made of the same material as the biasing member 16, however, may also be made of other complementary materials such as elastics, elastomers, rubber or the like, disposed about the ends at biasing member 16 i.e., a sleeve.

FIG. 3*b* details the interior of the housing 12 and adaptive end 30 maintaining a back plate 50. The back plate 50 maintains the port connection receiving member 32 and also maintains threaded receiving members 52 adapted to receive respective jack screws of the traditional jack screw type port connection fastener.

Preferably, actuation of the biasing member 16 is accomplished by compression of buttons 28. When buttons 28 are compressed inwardly, the inner surfaces 35 of buttons 28 correspondingly compress respective wings 38 of biasing member 16. Such compression of wings 38 correspondingly disposes the associated prongs 26 inwardly in the slots 40 of the plate 32. Release of the buttons 28 allows the biasing member 16 to spring outwardly until prongs 26 engage the respective outer edge of plate 32. Flanges 44 of buttons 28 maintain buttons 28 within housing 12.

Biasing member 16 may be of a variety of different configurations. Resilient materials and designs are preferable in the preferred embodiment of this design, however, uncompromising materials are not precluded in the manufacture of this mechanism. Preferable materials include, but are not limited to, springs or spring-like mechanisms, for example, however, obvious variations are not precluded. The embodiment depicted in FIGS. 3*a–b* shows the biasing member 16 configured as a spring or spring-like mechanism. Moreover, while adaptor 10 is shown to be a male-type connector adapted to connect to a female receptive connector 24, the reverse orientation is possible. Likewise, adaptive end 30 maintaining port connection 32 is shown to be a female type receptive connector adapted to connect to a male type connector, however the reverse orientation is possible. Furthermore, both port connectors in their respective areas of the adaptor 10 may be of the same configuration, both male or both female, without varying from the scope of the intended invention.

Figure 4:
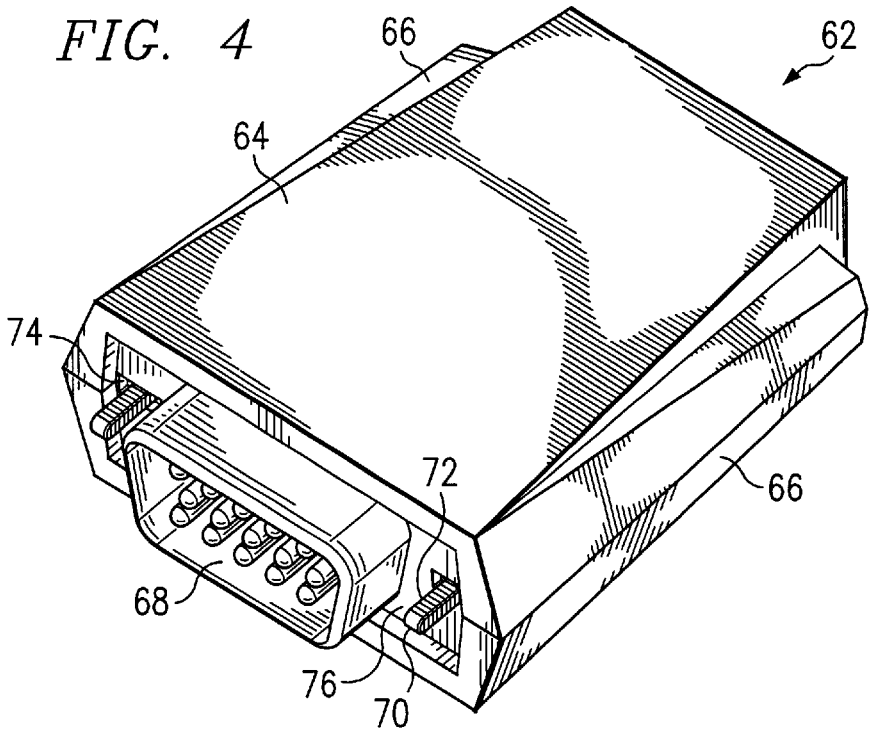
FIG. 4 is a perspective view of an alternative preferred embodiment for an easy lock computer port connector adaptor.

FIG. 4 is a pictorial view of an alternative embodiment of an easy to lock computer port adaptor 62. The computer port connector 62 depicted in this embodiment includes a housing 64 maintaining buttons 66, port connection 68 and a biasing member 70 terminating at grips 72. In this embodiment it is important to note biasing member 70 is capable of either inward or outward biasing within respective slots 74 in front plate 76. However, it is preferable to, for example, bias the member for actuation in the direction of the grips. For example, if inward biasing is preferable for the secure connection of the port adaptor 62 to a receiving member, it might be deemed preferable to include the grips on the inward side, or side closest to the port connection 68, of the biasing member 70. Again, actuation is preferable via the compression of buttons 66 located on either side of the biasing member 70.

Figure 5:
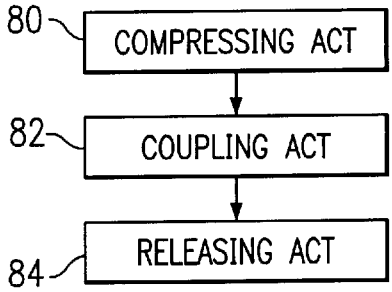
FIG. 5 is a block diagram showing the method of connecting the easy lock computer adaptor housing to a receiving member.

FIG. 5 is a block diagram showing the method of connecting an easy to lock computer port housing to a receiving member, such as shown in the previously described FIGS. 1–4 as adaptor 10 and 62. As disclosed above, the act of compressing 80 comprises squeezing the biasing member (16, 70) via the actuation of buttons (28, 66) located on the lateral side of the housing of the device (12, 64). Once the biasing member is compressed, the adaptor (10, 62) then maybe coupled to receptive connector 24 at step 82 by inserting the retracted prongs 26 or grips 72 in the internally threaded member 11. Once coupled, the buttons (28, 66) may be released at step 84 for a secure fit of the prongs 26 or grips 72 within the receptive member 20, for example, thereby securing the adaptor (10, 62) to the receptive connector 24.

The effort (work) one uses to actuate the biasing member 16 is a function of the motion of the pivot point of the biasing member 16 being a result of the force applied to the pivot point and the distance the prongs 26 or grips 72 move along a line of displacement. Thus, the location of the pivot point is critical to the amount of work necessary to the application of the device.

Although the buttons (28, 66) are shown to be side buttons for the lateral displacement of the biasing member 16, buttons (28, 66) may be of a variety of different placements along the device such as the back, top and bottom of the device, for example.

Figure 6:
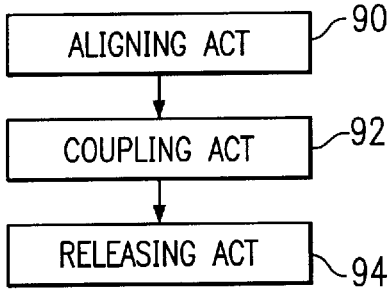
FIG. 6 is a block diagram showing the method of connecting an easy to lock computer port housing to a typical jack screw type port connection.

FIG. 6 is a block diagram showing the method of connecting the easy to lock computer port housing to a typical jack screw type port connection, such as shown in the previously described FIGS. 1–4 as adaptors 10 and 62. As disclosed above, the act of alignment 90 comprises lining up adaptor 10 and 62 with the traditional jack screw connector 36 having screw-type fasteners or the like. The traditional jack screw connector 36 is thus securingly connected to the port adaptor 10 and 62 via the screw-type receptors 34 of the port adaptor 10 and 62 during the coupling step 92. Releasing step 94 comprises detachment of the securing connection portions of the traditional jack screw connector 36 from the receptors 34 of the port adaptor 10 and 62.

Although preferred embodiments of the method and system of the present invention has been illustrated in the accompanied drawings and described in the foregoing detailed description, it is understood that obvious variations, numerous rearrangements, modifications and substitutions can be made without departing from the spirit and the scope of the invention as defined by the appended claims.

What is claimed is:

1. A port adaptor adapted to connect to a receiving member and to a port connector, comprising:

a housing;

a first port connection coupled to said housing and capable of connection to the port connector;

a second port connection coupled to said housing and connected to a plurality of electrical conductors; and a clasp coupled to said housing and adapted to releasingly secure said second port connection to the receiving member, said clasp actuatable via compression of said clasp, wherein the clasp having an end portion is adapted to be received by a screw-type port connection comprising a hole with internal threads, and wherein the end portion of the clasp interacts with the threads of the hole.

2. The adaptor of claim 1 wherein said first port connection and said second port connection are at opposing ends of said housing.

3. The adaptor of claim 1 wherein the housing maintains buttons adapted to actuate said clasp.

4. The adaptor of claim 1 wherein either said first or said second port connection is a parallel port connection.

5. The adaptor of claim 1 wherein either said first or said second port connection is a serial port connection.

6. The adaptor of claim 1 wherein either said first or said second port connection is a video port connection.

7. The adaptor of claim 1 wherein the clasp is a biasing member.

8. The adaptor of claim 7 wherein the biasing member is resilient.

9. The adaptor of claim 8 wherein the biasing member is a spring.

10. The adaptor of claim 7 wherein the biasing member is biased inwardly.

11. The adaptor of claim 7 wherein the biasing member is biased outwardly.

12. The adaptor of claim 1 wherein the clasp has distal ends including grips adapted to securingly connect the connection to the receiving member.

13. The adaptor of claim 12 wherein the grips are teeth.

14. The adaptor of claim 12 wherein the grips are elastic.

15. A method of coupling a port connector to a receiving member using an adaptor, said adaptor comprising;

a first and second port connection and a plurality of electrical conductors coupled there between, and a clasp adapted to selectively secure said second port connection to the receiving member, wherein said clasp having an end portion is adapted to be received by a screw-type port connection comprising a hole with internal threads, and wherein the end portion of the clasp interacts with the threads of the hole;

comprising the step of:

coupling said first port connection to the port connector and said second port connection to said receiving member by selectively biasing the clasp against the screw-type port connection.

16. The method of claim 15 wherein the clasp is a biasing member.

17. The method of claim 16 wherein the biasing member is biased outwardly.

18. The method of claim 15 wherein the clasp has distal ends including grips adapted to securingly connect the connection to the receiving member.

19. The method of claim 18 wherein the grips are ratchet like.

* * * * *